US008827238B2

(12) United States Patent
Geddes et al.

(10) Patent No.: US 8,827,238 B2
(45) Date of Patent: Sep. 9, 2014

(54) FLOW CONTROL DEVICE

(75) Inventors: Frazer Geddes, Kinellar (GB); Atul B. Sood, Aberdeen (GB); Gilbert Alexander Anderson, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 95 days.

(21) Appl. No.: 13/131,459

(22) PCT Filed: Dec. 4, 2009

(86) PCT No.: PCT/GB2009/051654

§ 371 (c)(1),
(2), (4) Date: Aug. 19, 2011

(87) PCT Pub. No.: WO2010/064053

PCT Pub. Date: Jun. 10, 2010

(65) Prior Publication Data

US 2011/0297254 A1 Dec. 8, 2011

(30) Foreign Application Priority Data

Dec. 4, 2008 (GB) ..... 0822144.2

(51) Int. Cl.

| | |
|---|---|
| ***F16K 47/00*** | (2006.01) |
| ***E21B 34/10*** | (2006.01) |
| ***E21B 34/14*** | (2006.01) |
| *E21B 34/00* | (2006.01) |

(52) U.S. Cl.

CPC ..... *E21B 34/14* (2013.01); *E21B 34/101* (2013.01); *E21B 2034/007* (2013.01)

USPC ..... 251/118; 251/126; 251/127; 277/417

(58) Field of Classification Search

USPC ..... 251/117, 118, 214, 340, 343, 126, 127; 137/508; 277/411–412, 417; 166/320, 166/334.4

See application file for complete search history.

(56) References Cited

U.S. PATENT DOCUMENTS 3,216,452 A * 11/1965 Williams ..... 137/614.13
3,227,228 A 1/1966 Bannister (Continued)

FOREIGN PATENT DOCUMENTS

WO WO-2012065123 A2 5/2012
WO WO-2012065126 A2 5/2012

OTHER PUBLICATIONS

Garrido, Garcia M., "International Search Report" for PCT/GB2009/051654 as mailed Mar. 24, 2010, 5 pgs.

*Primary Examiner* — Craig Schneider
*Assistant Examiner* — Jessica Cahill
(74) *Attorney, Agent, or Firm* — Winstead PC

(57) ABSTRACT

A flow control device typically for protecting a seal (20) in a valve, wherein a body portion (5) has an orifice (8) allowing fluid flow, and the valve has a control portion (10) to allow and restrict fluid flow through the orifice. The flow control device has a fluid flow controller (30) between the body portion and the control portion in the form of at least one annular ring (35), disposed in a recess in one of the body portion and the control portion (10). The fluid flow controller (30) defines a leak path through the device that is opened and closed by a pressure differential acting across the annular member. Typically the application of a pressure differential across the fluid flow controller moves the ring(s) to one end of the recess and reduces the cross sectional area of the leak path available to the fluid, thereby diffusing the fluid flow through the orifice (8).

24 Claims, 17 Drawing Sheets

(56) References Cited

U.S. PATENT DOCUMENTS

| | | | | | |
|---|---|---|---|---|---|
| 3,233,674 | A | | 2/1966 | Leutwyler | |
| 3,355,142 | A | | 11/1967 | Kammerer et al. | |
| 3,914,732 | A | | 10/1975 | Brumleve et al. | |
| 4,134,454 | A | | 1/1979 | Taylor | |
| 4,290,610 | A | * | 9/1981 | Lizogub et al. | 277/417 |
| 4,302,019 | A | * | 11/1981 | Hotger | 277/417 |
| 4,432,417 | A | | 2/1984 | Bowyer | |
| 4,617,960 | A | | 10/1986 | More | |
| 4,712,613 | A | | 12/1987 | Nieuwstad | |
| 4,771,831 | A | | 9/1988 | Pringle et al. | |
| 4,796,699 | A | | 1/1989 | Upchurch | |
| 4,856,595 | A | | 8/1989 | Upchurch | |
| 4,896,722 | A | | 1/1990 | Upchurch | |
| 4,915,168 | A | | 4/1990 | Upchurch | |
| 5,046,718 | A | * | 9/1991 | Hay, II | 277/303 |
| 5,078,175 | A | * | 1/1992 | Martin et al. | 137/242 |
| 5,146,983 | A | | 9/1992 | Hromas et al. | |
| 5,203,414 | A | | 4/1993 | Hromas et al. | |
| 5,226,494 | A | | 7/1993 | Rubbo et al. | |
| 5,316,084 | A | | 5/1994 | Murray et al. | |
| 5,343,963 | A | | 9/1994 | Bouldin et al. | |
| 5,558,153 | A | | 9/1996 | Holcombe et al. | |
| 5,579,283 | A | | 11/1996 | Owens et al. | |
| 5,611,401 | A | | 3/1997 | Myers, Jr. et al. | |
| 5,706,896 | A | | 1/1998 | Tubel et al. | |
| 5,893,413 | A | | 4/1999 | Lembcke et al. | |
| 5,941,281 | A | * | 8/1999 | Baumann et al. | 137/625.33 |
| 5,971,022 | A | * | 10/1999 | Hayashi et al. | 137/625.69 |
| 6,012,518 | A | | 1/2000 | Pringle et al. | |
| 6,021,095 | A | | 2/2000 | Tubel et al. | |
| 6,055,213 | A | | 4/2000 | Rubbo et al. | |
| 6,109,357 | A | | 8/2000 | Zimmerman | |
| 6,244,351 | B1 | | 6/2001 | Patel et al. | |
| 6,260,616 | B1 | * | 7/2001 | Carmody et al. | 166/66 |
| 6,308,137 | B1 | | 10/2001 | Underhill et al. | |
| 6,349,772 | B2 | | 2/2002 | Mullen et al. | |
| 6,384,738 | B1 | | 5/2002 | Carstensen et al. | |
| 6,388,577 | B1 | | 5/2002 | Carstensen | |
| 6,414,905 | B1 | | 7/2002 | Owens et al. | |
| 6,422,317 | B1 | * | 7/2002 | Williamson, Jr. | 166/374 |
| 6,488,082 | B2 | | 12/2002 | Echols et al. | |
| 6,494,265 | B2 | | 12/2002 | Wilson et al. | |
| 6,624,759 | B2 | | 9/2003 | Tubel et al. | |
| 6,684,953 | B2 | | 2/2004 | Sonnier | |
| 6,710,720 | B2 | | 3/2004 | Carstensen et al. | |
| 6,722,439 | B2 | * | 4/2004 | Garay et al. | 166/373 |
| 6,760,275 | B2 | | 7/2004 | Carstensen | |
| 6,782,948 | B2 | | 8/2004 | Echols et al. | |
| 6,966,380 | B2 | * | 11/2005 | McLoughlin et al. | 166/320 |
| 7,025,146 | B2 | | 4/2006 | King et al. | |
| 7,044,229 | B2 | | 5/2006 | Tennoy et al. | |
| RE39,583 | E | | 4/2007 | Upchurch | |
| 7,201,231 | B2 | | 4/2007 | Chaplin et al. | |
| 7,295,491 | B2 | | 11/2007 | Carstensen | |
| 7,322,410 | B2 | | 1/2008 | Vinegar et al. | |
| 7,337,850 | B2 | | 3/2008 | Contant | |
| 7,363,981 | B2 | | 4/2008 | Coon et al. | |
| 7,510,001 | B2 | | 3/2009 | Spring et al. | |
| 7,562,712 | B2 | | 7/2009 | Cho et al. | |
| 7,588,100 | B2 | | 9/2009 | Hamilton | |
| 7,665,527 | B2 | | 2/2010 | Loretz | |
| 7,690,400 | B2 | * | 4/2010 | Haines | 138/42 |
| 2003/0183392 | A1 | | 10/2003 | Garay et al. | |
| 2005/0284642 | A1 | | 12/2005 | Wong | |
| 2008/0061513 | A1 | * | 3/2008 | Awtar et al. | 277/355 |
| 2008/0149345 | A1 | | 6/2008 | Marya et al. | |
| 2010/0044034 | A1 | | 2/2010 | Bailey et al. | |
| 2012/0065126 | A1 | | 3/2012 | Bruser et al. | |

* cited by examiner

FLOW CONTROL DEVICE

The present invention relates to a flow control device. In one embodiment the invention is suitable for restricting or diffusing fluid flow through an orifice of a valve. In other embodiments, the flow control device of the invention can comprise a sealing device.

In the field of downhole tools, and in many other mechanical devices, it is commonplace for an orifice in one component of a valve to be sealed by the movement of one surface against the orifice, for example, by a sliding sleeve, or by the rotation of a ball, each of which can have sealing elements that move across the orifice during opening and closing.

For example, in sliding sleeve valves, an orifice in a valve body can be occluded by a sliding sleeve that is sealed onto the inner or outer surface of the body by a pair of annular seals such as o-rings. Typically, the o-rings are spaced apart on the sleeve, and are disposed in annular recesses on either side of the orifice. When the o-rings straddle the orifice and are compressed between the sliding sleeve and the body, the orifice is effectively sealed off. When the orifice is to be opened, the sliding sleeve is moved axially so that one of the o-rings slides over the surface of the orifice, to allow fluid flow through the orifice. This method of covering and uncovering an orifice is extremely common, and it works very well in systems with low flow rates, and low pressures.

When a sliding sleeve or equivalent ball valve is used in conditions of high fluid pressure and/or high flow rates, basic seals such as annular rubber o-rings tend to become damaged by the high flow rates and/or high volumes of fluid that rush past the o-ring at the moment when it first uncovers the orifice during opening of the valve (called "unloading" the seal). The damage can be mechanical damage; for example, the o-ring seal can become physically dislodged from its recess, or can break or tear as the seal passes the orifice. The seal can also remain in place, but can be eroded by the flow of fluid. Erosion damage to the seal (and other parts of the valve, such as the valve seat) during unloading can be reduced by opening the valve very quickly, but is particularly common during slow opening valves. Therefore, high pressure valves are often sealed with more exotic seals, such as bonded or moulded rubber seals, plastic seals, or ceramic or metal seals, which are stiffer than rubber and are increasingly able to withstand the high pressure rush of fluid past the seals during unloading. More exotic seals are normally more expensive, more difficult to fit, more difficult to re-dress, and can require lower tolerances in the surrounding components, which can increase the cost of other parts of the valve.

According to the present invention there is provided a flow control device comprising

- a body portion with an orifice adapted to allow fluid flow through the orifice;
- a control portion that is adapted to change configurations between a first configuration that allows fluid flow through the orifice, and a second configuration that restricts fluid flow through the orifice; and
- a fluid flow controller disposed between the body portion and the control portion;
- wherein the fluid flow controller comprises at least one annular member, disposed in a recess in one of the body portion and the control portion;
- wherein the flow controller has a leak path that is opened and closed by a pressure differential acting across the annular member.

In one embodiment, the fluid flow controller is a diffuser.

In one embodiment the fluid flow controller can have multiple rings.

The number of rings can vary, for example, 2, 3, 4 or 5 rings can be provided in a satisfactory fluid flow controller. More rings can be provided if desired.

The recess typically has an axis. The axis can optionally be parallel to the axis of the annular member(s). The control portion and optionally the body portion can typically be in the form of sleeves with axes, and the axes of the sleeves can optionally be parallel to the axes of the recess and the annular member(s).

In one embodiment, the fluid flow controller is a sealing device.

The fluid flow controller can typically be activated or deactivated by pressure differentials acting on the flow controller to change the configuration of the annular member in response to the pressure differential.

The change in configuration of the annular member(s) is typically axial movement and/or radial movement of the annular member within the recess (typically with respect to the axis of the recess).

In one embodiment, multiple annular members are disposed in the same recess

In one embodiment, each annular member is disposed in a respective recess.

The annular member(s) may have a central axis. The annular member(s) can typically be arranged in a stack parallel to one another, typically in the axial direction of the annular member(s) and/or the recess. Typically annular members are stacked pressing against one another within the recess.

The recess may optionally have radial walls that are inclined and are not orthogonal to their central axes. The radial walls of the annular member(s) may be inclined at the same angle as the radial walls of the recess in which it is disposed, so that the radial walls of the annular member and the recess match one other. In one embodiment the radial walls of the annular member(s) is inclined such that the axial dimension of the annular member(s) at the radially outer edge is greater than the axial dimension of the annular member(s) at the radially inner edge. The annular member(s) in such an embodiment are is therefore wedge-shaped with a thick end disposed radially outward from a thin end, which is radially inward.

Optionally a seal can be formed by the pressing of a flat portion of the annular member against a flat portion of the recess.

The radial walls of the recess are typically formed parallel to the inclined radial walls of the annular members, The axial movement of the annular members within the recess caused by pressure differentials acting across the fluid flow controller can optionally push the radial walls of the recess and the annular member together.

Optionally the annular member can be forced radially out of the recess by the cooperating action of the inclined walls.

The flow control device can incorporate a seal, such as a an o-ring seal, a bonded or moulded rubber seal, or a ceramic or metal seal, in addition to the flow controller, although the flow controller can optionally be used without a separate seal, for example, with viscous fluids, or where a tight seal is not required, or where the flow controller is being used to prevent or reduce erosion damage to valve seats or other components.

The annular member(s) is typically a metal ring, optionally made from a resilient metal such as titanium or a ferrous metal such as e.g. steel or iron, e.g. cast iron. Using metal for the annular member(s) has a mechanical advantage during unloading. It is particularly advantageous to use materials with a degree of lubricity, such as cast iron. Titanium is also useful as a material for the ring(s), because it has a Young's modulus of approximately half that of steel and can deform extensively within its elastic deformation limit. Also, thicker ring(s) can be made from titanium allowing the resilience of the ring(s) to be tailored to the requirements of the valve. Thicker rings and deeper grooves are advantageous because thicker and stronger rings are less likely to be forced out of the groove under pressure and can incorporate more resilience. The material of the annular member(s) is typically more resilient than the material of the recessed body or control portion in which the annular member(s) are located. The recess can be an annular groove in the surface of either of the body or control portions.

The annular member(s) can optionally comprise split rings.

The annular members can optionally be biased radially in the recess, either outwardly or inwardly.

The flow controller typically provides a metal to metal seal.

In some embodiments the annular members can be formed from plastics material.

The annular member(s) can be a split ring, which can optionally be resiliently loaded to an extent sufficient to retain it in the groove in one of the body and control portions, but can optionally also be resiliently loaded to an extent sufficient to urge it against the surface of the other of the body and control portions, typically while clearing the inner surface of the groove, but remaining within the groove. Typically the ring(s) is capable of being stretched within its elastic limits to pass over the major diameter of the grooved portion, and is capable of returning elastically to its resting state within the groove, without engaging the minor diameter of the groove.

The groove can be in either of the body or control portions. For example, where the flow control device is embodied in a sliding sleeve valve, with an orifice in the body and an inner sleeve sliding on the inner surface of the body, then the groove can typically be in the outer surface of the inner sleeve. In other embodiments, for example, where the sliding sleeve is external to the body, then the groove can be on the inner surface of the sleeve. In either case, the groove could be located on the body portion instead of the sleeve portion.

The axial dimension of the groove is typically sufficient to allow some axial movement of the annular member within the groove. For example, the total axial dimension of the ring(s) can typically take up 70-98% of the axial dimension of the groove, so that the ring(s) can move axially relative to the groove, typically under the force of the fluid flow.

In an embodiment with a single ring in a single groove, the difference in the axial spacing between the ring and the groove can be minimal, and the ring can be a relatively tight axial fit within the groove, typically able to move axially in order to activate and deactivate the fluid flow controller, but accommodating close to 98% of the axial space of the groove.

In an embodiment with more than one ring in the groove, the difference in axial spacing can be greater. For example, if the groove has an axial dimension of 5 mm, and if the total axial dimension of each ring is 2 mm, the groove is typically loaded with 4 rings, leaving some space (around 2 mm) for axial movement of the rings within the groove. Typically 2 or more rings are provided, although this can be tailored to suit the pressure rating of the valve, and sometimes with high pressure valves, 6, 10 or more rings can be used, in a suitably dimensioned groove.

The fluid flow controller is typically located upstream of the orifice with respect to the direction of fluid flow, and typically upstream of any seal in a valve. Typically the fluid flow controller defines a labyrinthine passage between the upstream fluid and the orifice and optionally the seal, for diffusing fluid flowing through the orifice. In some embodiments, the fluid flow controller can be provided downstream of the seal.

When the fluid flow controller is exposed to a pressure differential due to a configuration change in the control portion, the ring(s) is typically forced to move toward one end of the groove. This presses the ring against one end of the groove, and in embodiments where more than one ring is present, the rings are also pressed together within the groove. This typically reduces the available cross-sectional area of the leak path for the fluid to reach the orifice. Increasing pressure forces the ring(s) tighter together or against the wall of the groove, thereby further reducing the cross sectional area of the leak paths to the orifice, and diffusing the force of the fluid reaching and passing through the orifice and seal.

The split ends of the ring can typically provide the leak path for the fluid to pass between the ends of the ring. The dimensions of the leak path (e.g. the length or the cross sectional area) can be adjusted in particular embodiments to give different effects. The dimensions of the leak path are typically changed by the pressure differential across the fluid flow controller.

The split ends of the ring(s) are typically forced apart against the natural resilience of the ring(s) to fit them initially into the groove(s), and are then relaxed within the groove(s) so that the split ends approach one another and the gap between them typically approaches zero.

In certain embodiments, the rings can have overlapping ends, optionally cut at an oblique angle. Typically the length of the leak path through the cut ends is dependent on the length of the overlap, so increasing the length of the overlap increases the length of the leak path. Also, increasing the extent to which the ends are pressed together typically reduces the cross sectional area of the leak path. With longer overlaps, and higher forces pressing the ends together, the flow rate through the leak path decreases towards zero, and the effectiveness of the diffuser therefore increases.

In some embodiments, the relaxed rings are freely movable relative to the groove. In embodiments with more than one ring, the gaps between the free ends of the rings can optionally be circumferentially staggered out of alignment with one another. This increases the labyrinthine effect of the fluid flow controller. In some cases, the rings can be indexed, so that the circumferential position of the rings relative to one another is maintained, and the rings are prevented from rotating in the groove. The indexing helps to maintain the circumferential staggering of the split ends of the rings. The indexing can be achieved by an indexing pin connecting the rings, or by a rod or bar or other protrusion residing in a radial recess in the rings.

In some embodiments, typically those with more than one ring per groove, some of the rings in the groove can be of different resting diameters so that they are radially offset with respect to one another. For example, some rings (optionally axially adjacent rings) in the groove can be sprung inward against the inner surface of the groove, and some can be sprung outward in the groove. This blocks the fluid pathway both outside and inside the rings, thereby forcing the fluid to take a path that changes its radial direction and enhancing the diffuser effect by modifying the labyrinthine pathway through the fluid flow controller. All rings are typically retained within the groove, regardless of the direction of spring bias. At least some of the rings are typically biased away from the grooved portion into the face of the other portion. In this arrangement, the rings biased away from the grooved portion but restrained within the groove will substantially occlude the annulus between the two portions, and will therefore decrease the available surface area of the leak path to the orifice.

Typically the distance between the fluid flow controller and any seal is not less than the distance across the orifice, so that the seal and the diffuser do not engage the orifice at the same time. Usefully the distance between the fluid flow controller and the seal is greater than the maximum distance across the orifice, and across any recess associated therewith, so that the seal has passed over the orifice completely before the fluid flow controller engages the orifice. In such embodiments, the seal is never exposed to the full pressure of the fluid without the protection of the fluid flow controller.

In certain embodiments, the radially outer edges of the rings can be bevelled or chamfered to interact more easily with bevelled or chamfered orifices. Typically the bevel on the ring is adapted to match the bevel on the orifice as the ring approaches the orifice during closing of the valve.

In one aspect, the invention provides a flow control device comprising

- a body portion with an orifice adapted to allow fluid flow through the orifice;
- a control portion that is adapted to change configurations between a first configuration that allows fluid flow through the orifice, and a second configuration that restricts fluid flow through the orifice; and
- a fluid flow diffuser disposed between the body portion and the control portion;
- wherein the fluid flow diffuser comprises at least two annular members disposed in a recess in one of the body portion and the control portion.

Embodiments of the present invention permit the protection of basic designs of seal during unloading in pressurised valves, especially in high pressure valves, to achieve the higher performance of more advanced designs of seal at lower cost and with fewer attendant disadvantages. Embodiments of the invention can also be used with more advanced designs of seals, such as bonded rubber, plastics or ceramics seals, in order to enhance their performance even further. In some embodiments, the stroke of the control portions necessary to open and close the valve can be reduced, which facilitates a more compact valve.

Embodiments of the present invention will now be described, by way of example, with reference to the accompanying drawings, in which.

Figure 1:
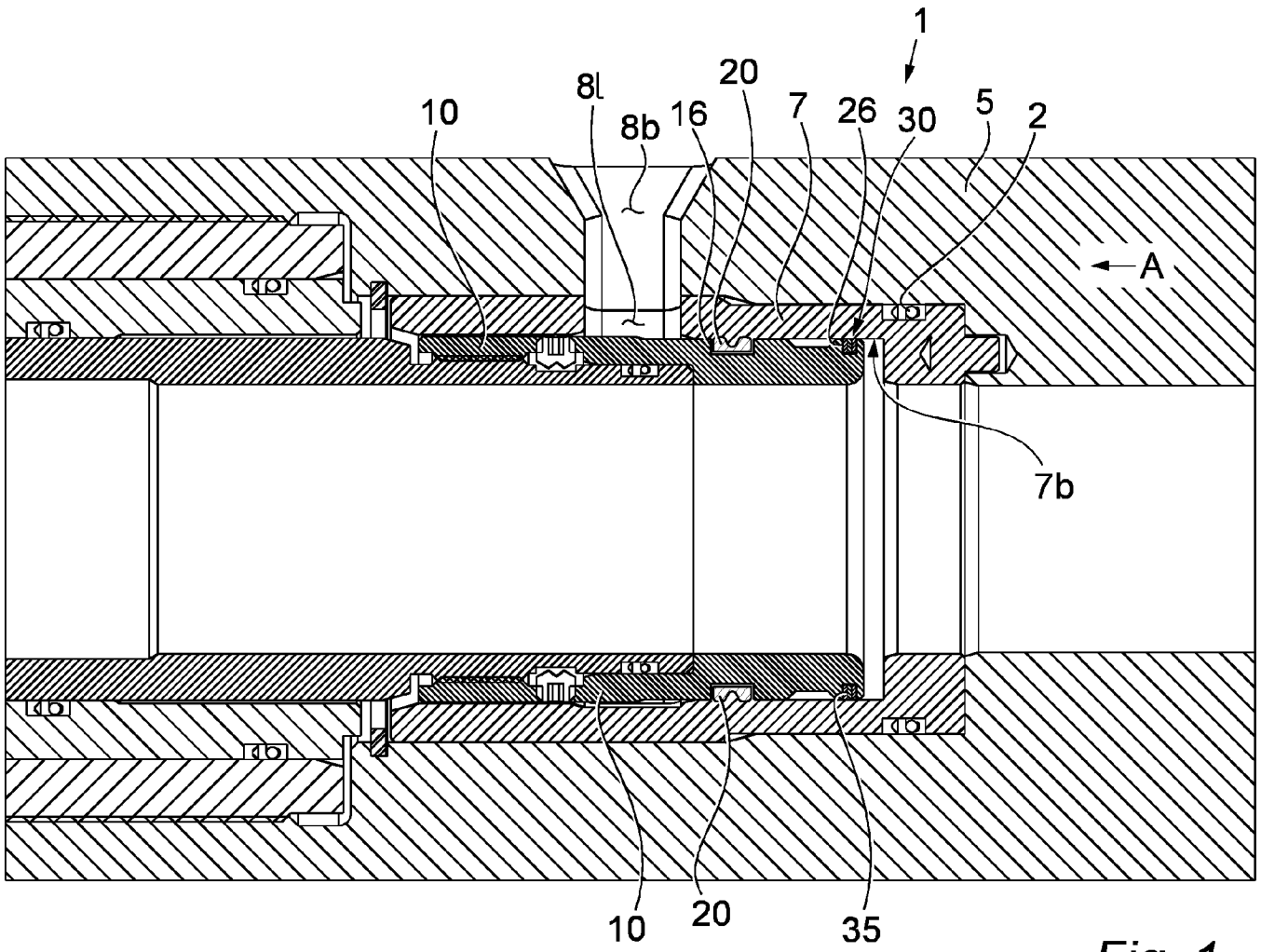
FIG. 1 is a side view of a first flow control device embodied in a sliding sleeve valve in a closed configuration.

Referring now to the drawings, FIG. 1 shows a sliding sleeve valve 1 comprising a valve body 5, a liner 7 within the bore of the body 5, and a control sleeve 10 within the bore of the liner 7. The body 5 has an orifice 8*b* to provide a fluid pathway from the inner bore of the body 5 to the outside of the body 5. The liner 7 has a radial orifice 8*l* communicating with the orifice 8*b*, and is hardened in the area of the orifice 8*l*. The liner 7 is sealed within the bore of the body 5 at 2, and retains the sleeve 10 within the bore of the body 5, providing an inner bore 7*b* against which the sleeve 10 can seal. The liner 7 is designed to be easily replaced once erosion damage to the orifice 8*l* has reached a certain point. The hardened orifice 8*l* in the liner 7 prevents or restricts the erosion of the orifice 8*b* in the body 5. The orifice 8*b* has rounded edges to reduce tearing or other damage to the seal when it passes the orifice. The liner 7 is optional. Only one orifice 8 is shown in the sectional view of FIG. 1, but as can be seen from other figures, there are e.g. 5 separate orifices in the body 5 and liner 7.

The sleeve 10 has a seal 20 in an annular groove 16 on its outer surface. The seal 20 is typically a bonded rubber seal, which is bonded or moulded in place in the groove 16, without being stretched, and then trimmed or moulded to the desired shape. The seal 20 can instead be of any desired type, and can, for example be a simple o-ring seal, a plastic seal, or a metal or ceramic seal. The groove 16 has a square or rectangular transverse section, with radially extending upper and lower sides to retain the seal axially within the groove, so that it can withstand the pressure of the fluid flowing past the groove during unloading of the seal.

The sleeve also has a fluid flow controller in the form of a diffuser 30 located in a second groove 26 displaced axially along the sleeve 10, toward the lower free end of the sleeve 10. The distance between the grooves 16 and 26 is typically greater than the diameter of the orifice 8.

The diffuser 30 takes the form of three annular rings 35, which are stacked parallel to one another in the axial direction of the sleeve 10. The rings 35 are typically identical to one another (although this is not essential) and typically have a thin axial dimension of approximately 0.03 inches (0.76 mm) with a radial depth of around 0.107 inches (2.7 mm).

The rings can be formed from a resilient material such as titanium or steel. Some embodiments are made from cast iron. The first embodiment described uses rings made from cast iron.

Figure 9:
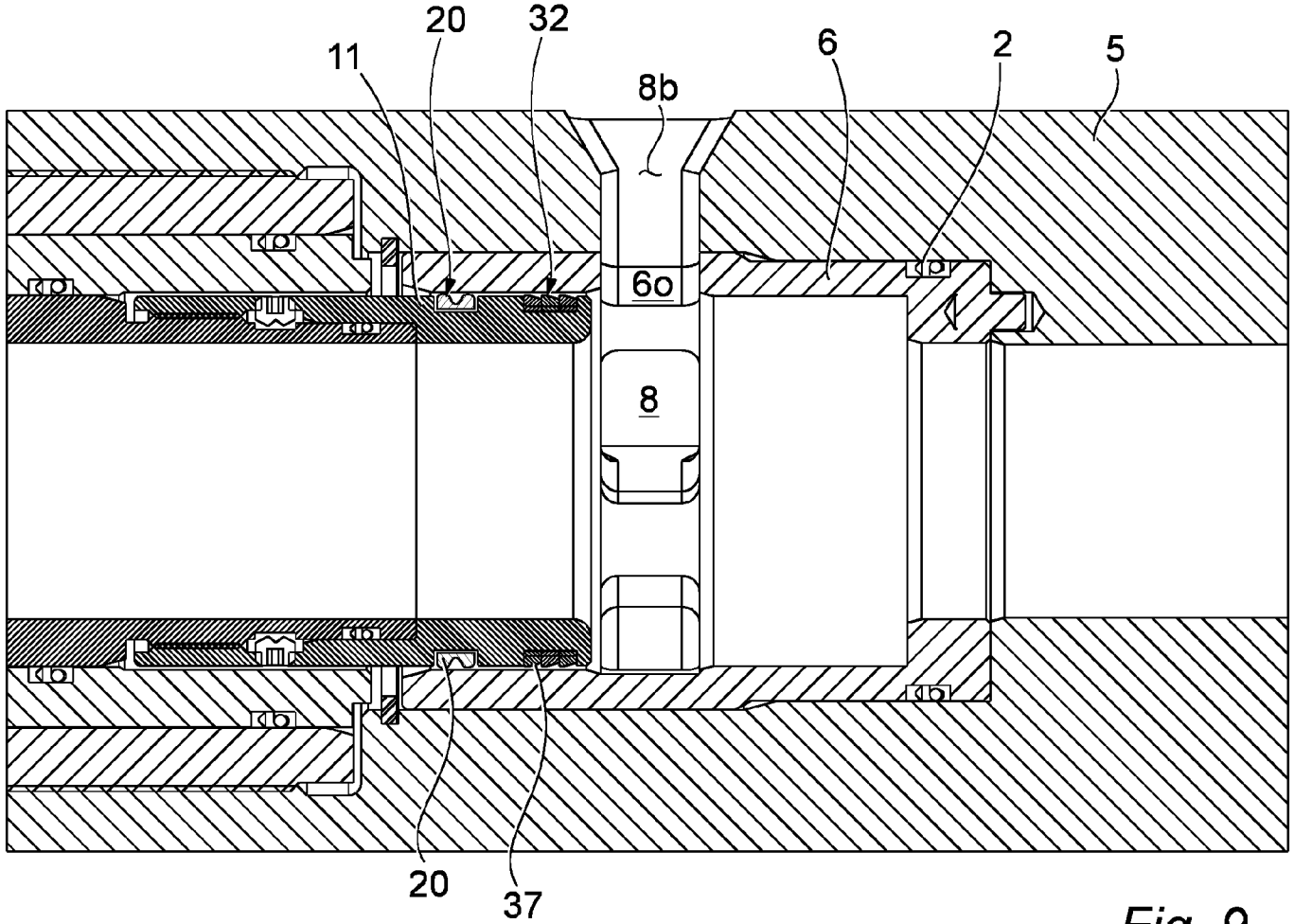
FIG. 9 is a side view of the third flow control device in the FIG. 7 valve in a fully open configuration.
Figure 10:
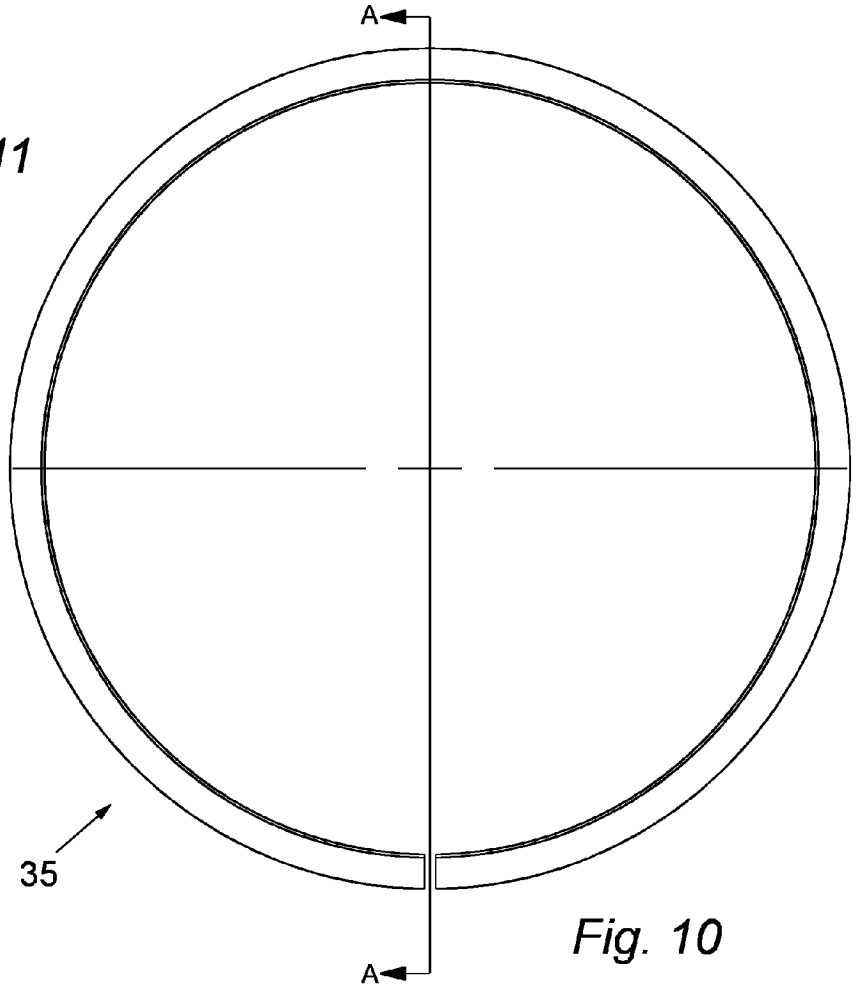
FIGS. 10, 11 and 12 are plan, side and expanded section views respectively, of a ring from the first flow control device shown in FIGS. 1-3.
Figure 11:
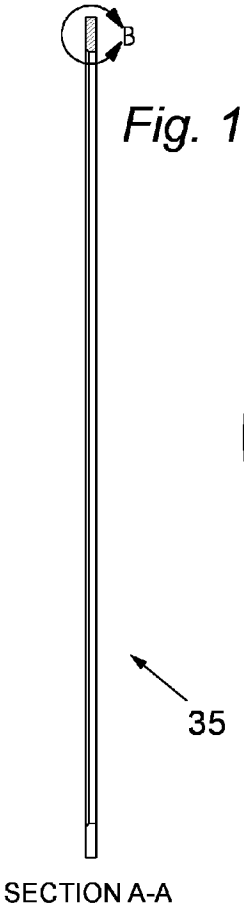
Figure 12:
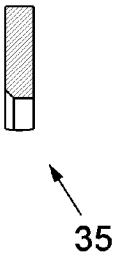
Figure 13:
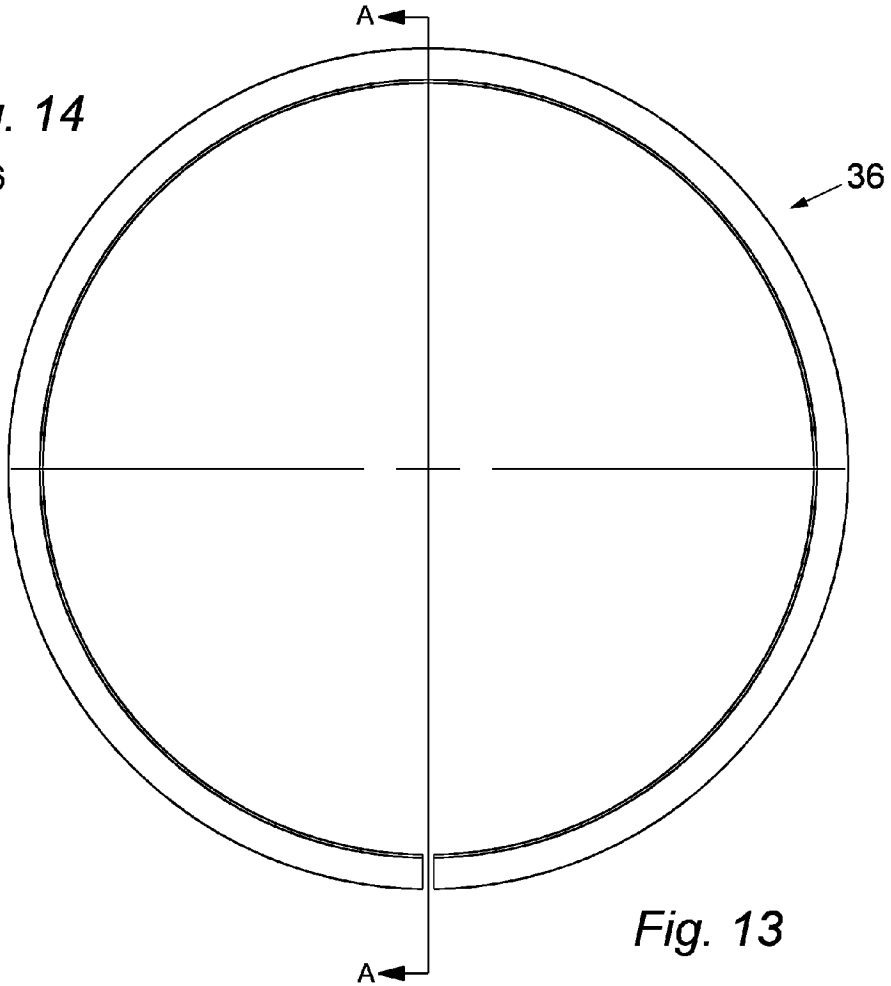
FIGS. 13, 14 and 15 are plan, side and expanded section views, respectively, of a ring from the second flow control device shown in FIGS. 4-6.

The rings are sprung and have a resting position as shown in FIG. 9, in which the opposed free ends are around 0.03 inches (0.76 mm).apart, and in which the diameter is slightly larger than the minor diameter of the second groove 26, causing the resting rings 35 to spring outwardly from the minor diameter so that they clear the inner surface of the groove 26, and in use are forced against the inner surface of the liner bore 7*b*. The major diameter of the sleeve 10 is larger than the resting diameter of the rings, so the rings need to be stretched apart to a wider diameter to pass over the outer surface of the sleeve 10 before snapping into the groove to resume their resting state. Thus the rings 35 are retained in the groove 26, and are slightly compressed inwardly by the inner surface of the liner 7, so that they are sprung outwardly against the inner surface of the liner 7, and the gaps between the free ends of the rings 35 approach zero. This leaves the rings 35 biased slightly away from the inner surface of the groove 26, but still axially retained within the depth of the groove 26.

Figure 2:
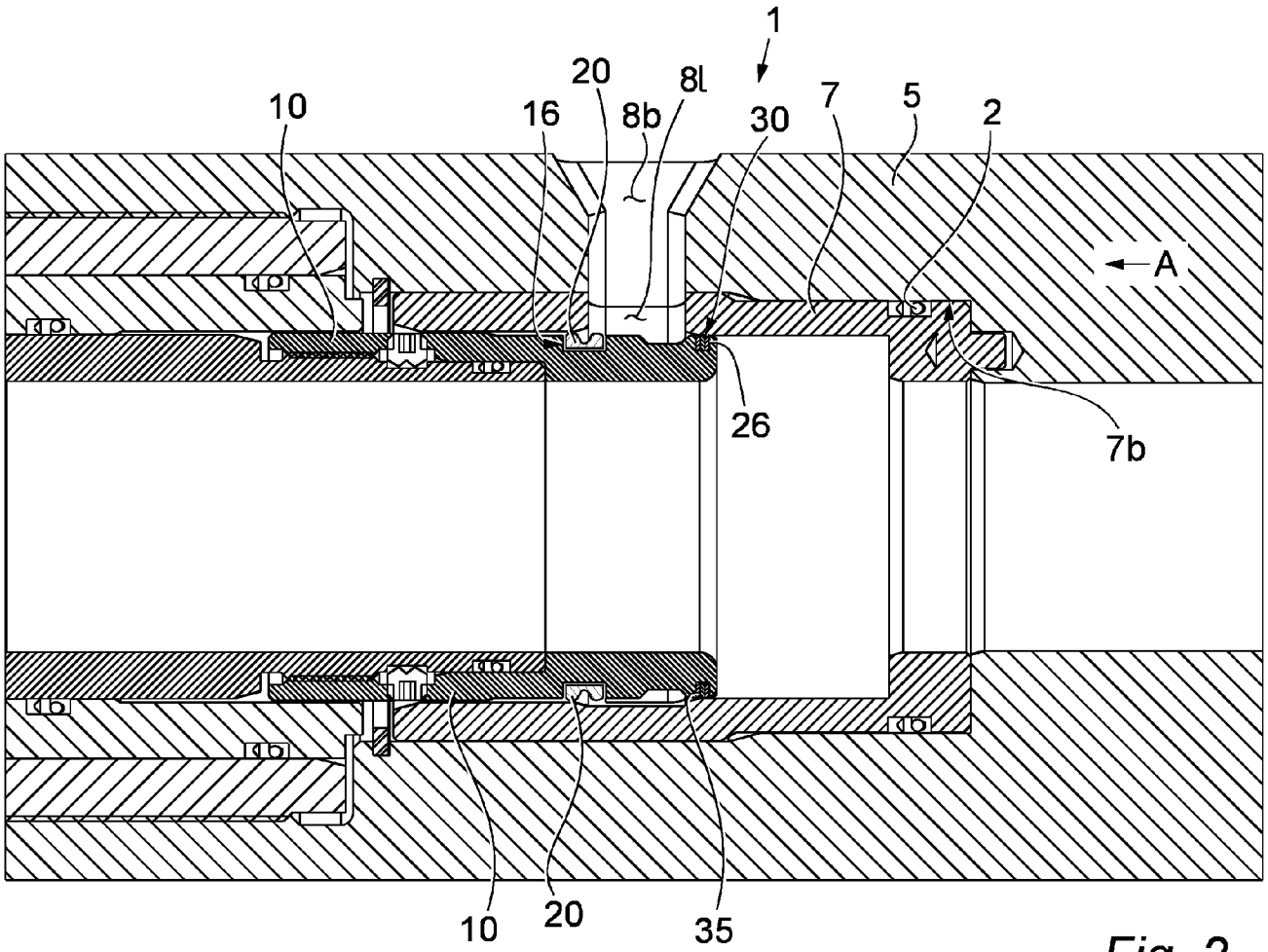
FIG. 2 is a side view of the first flow control device in the FIG. 1 valve in a partially open configuration.
Figure 3:
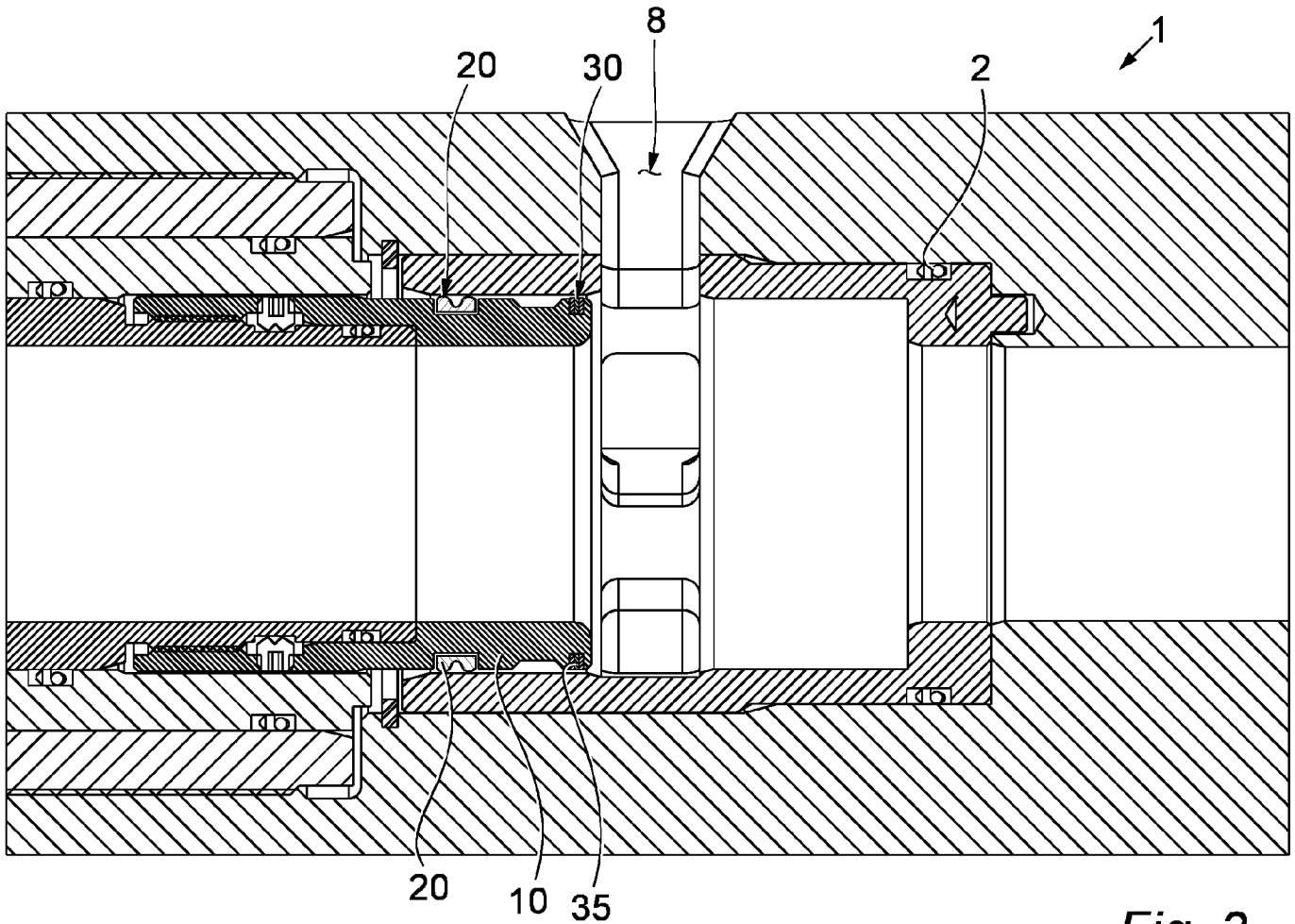
FIG. 3 is a side view of the FIG. 1 valve in an open configuration.
Figure 20:
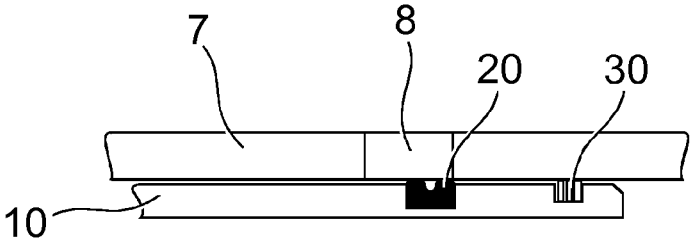

During opening of the valve, the sliding sleeve 10 moves upward in the bore of the liner 7, in the direction of arrow A, and the pressure remains generally static while the seal 20 approaches the orifice 8. Substantially no fluid flows past the seal or the diffuser 30 for as long as the seal 20 is pressed against the bore 7*b*. The diffuser 30 has no effect on the pressure or fluid flow at this point. Once the seal 20 passes the lower edge of the orifice 8, as shown in FIG. 2 and in FIG. 20, the seal is no longer sealed against the inner bore 7*b* and is unloaded. At this point, the fluid pressure is no longer held by the seal 20, and the fluid flows down the bore of the sleeve 10, through the open lower end of the sleeve, up the annulus in the direction of arrow A between the sleeve 10 and the liner 7, and out of the orifice 8. This compresses the seal 20 upward in the groove, against the upper radial wall of the groove 16. In cases where the pressure is high in the bore, and there is a large volume of fluid pressing down on the seal 20, the seal 20 can be eroded by the high pressure and high volume of fluid, or can sometimes be forced out of the groove 16. In the present embodiment, the forces applied to the seal 20 during unloading are reduced, because the diffuser 30 creates a non-linear leak path for the fluid to follow, which diffuses the force in the flow in the annulus reducing its velocity before it reaches the seal 20, thus reducing the flow rate reaching the seal, and thereby reducing erosion damage to the seal during unloading.

During unloading, the diffuser rings 35 force the fluid to flow around them, rather than simply allowing a linear passage of the flow up the annulus. The biasing of the rings 35 outward against the inner surface of the liner bore 7*b* restricts the extent to which the fluid can flow around the outside of the rings 35, thereby forcing the fluid to take a path inside the rings, between the rings 35 and the outer surface of the groove 26, or between the rings themselves, through the gaps between the free ends of the rings 35. Also, the rings 35 are pressed against the upper end wall of the groove 26, and are retained therein by the depth of the groove and the natural resting position of the sprung rings 35. Therefore, the fluid does not have a straight path in the annulus, and must follow a labyrinthine path created by the rings 35 of the diffuser.

Typically the axial length of the groove 26 containing the rings 35 is longer than the combined axial length of the rings 35, so that the rings 35 can optionally move axially in the groove. In the present example, the axial length of the groove 26 is around 0.1 inches (2.54 mm) and the axial dimension of each of the rings is around 0.03 inches (0.76 mm), leaving around 0.01 inches (0.254 mm) of unoccupied space in the groove to allow axial movement of the rings. This feature provides the diffuser with a choking effect, allowing relatively unhindered fluid flow at low pressures, where the rings 35 are "floating" axially within the groove, and greater impedance to the fluid flow past the diffuser when high pressures or high flow rates of fluid compress one or all of the rings 35 against the upper wall of the groove 26. High pressure or high rates of fluid flow pushes the rings together, and against the upper radial wall, which further reduces the available surface area of the leak path, and so restricts the flow of fluid past the rings 35.

Figure 21:
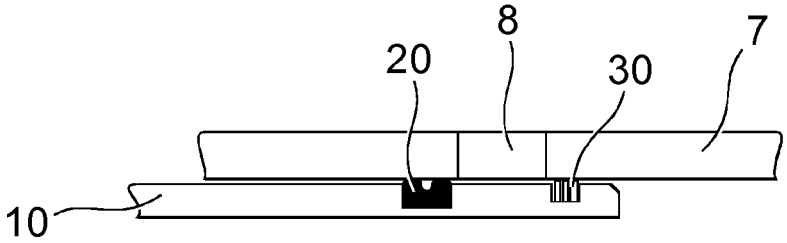
Figure 22:
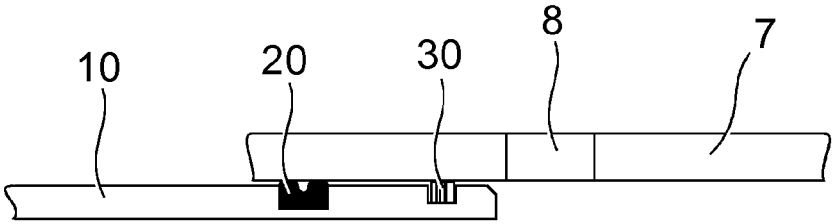
Figure 23:
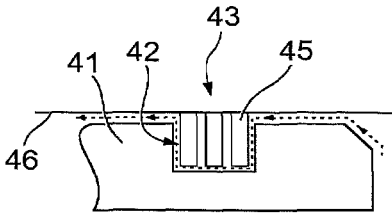
FIG. 23 is a close up schematic view of a first diffuser useable in any of the embodiments described.
Figure 25:
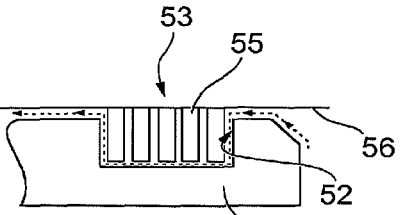
FIG. 25 is a close up schematic view of a third diffuser.
Figure 24:
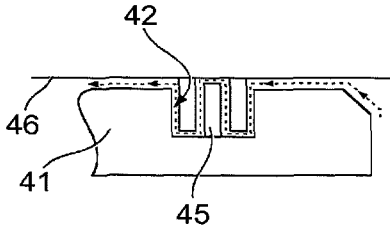
FIG. 24 is a close up schematic view of a second diffuser.

As shown in FIG. 21, the axial spacing between the seal 20 and the diffuser 30 is greater than the diameter of the orifice 8, so that the seal 20 is protected by the diffuser 30 for the full extent of its travel across the orifice 8. The diffuser 30 typically also crosses the orifice 8 and re-engages with the inner surface of the liner 7 at the upper end of the orifice 8, coming to rest in an open position as shown in FIG. 22.

Figure 4:
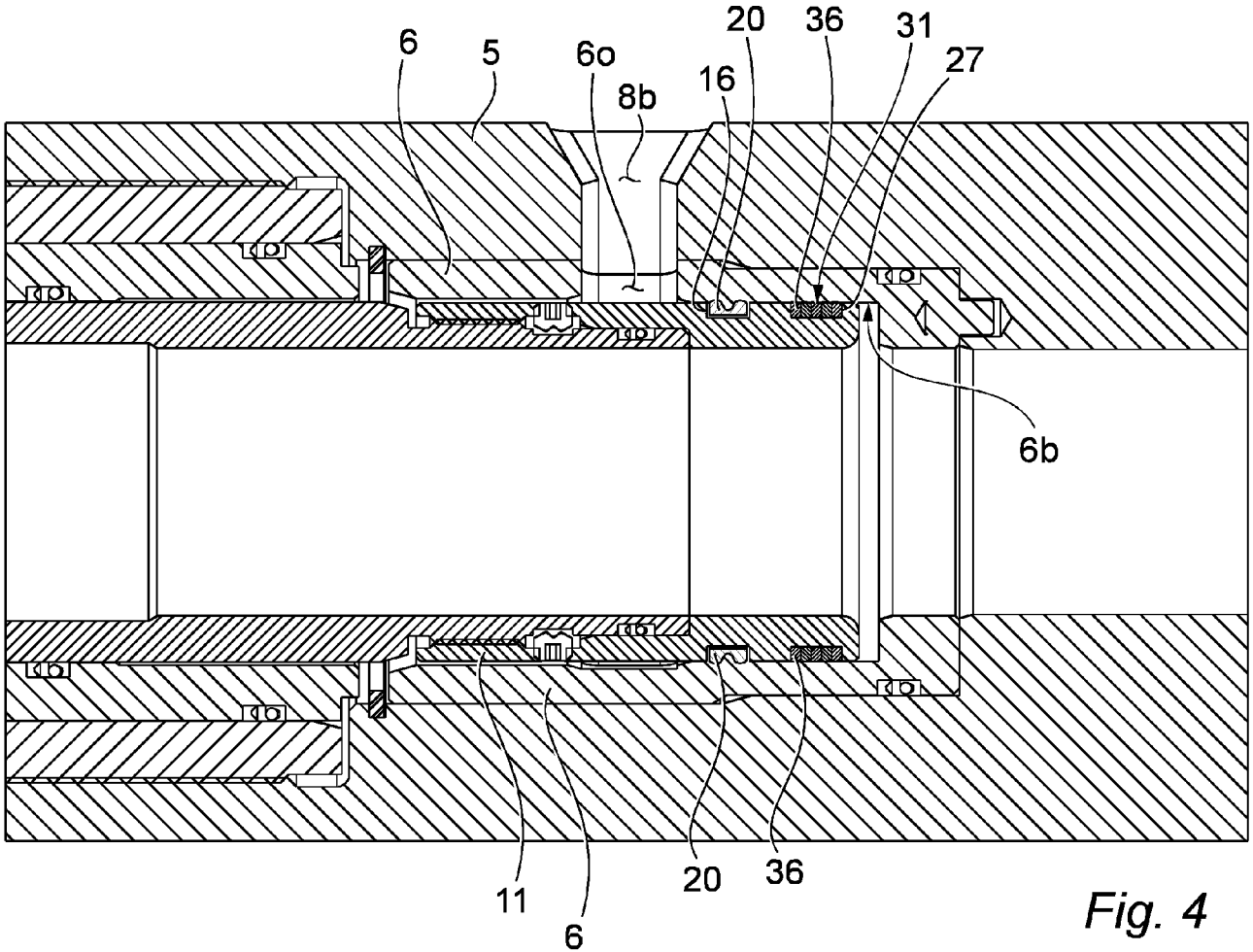
FIG. 4 is a side view of a second flow control device in a second sliding sleeve valve, in a closed configuration.
Figure 5:
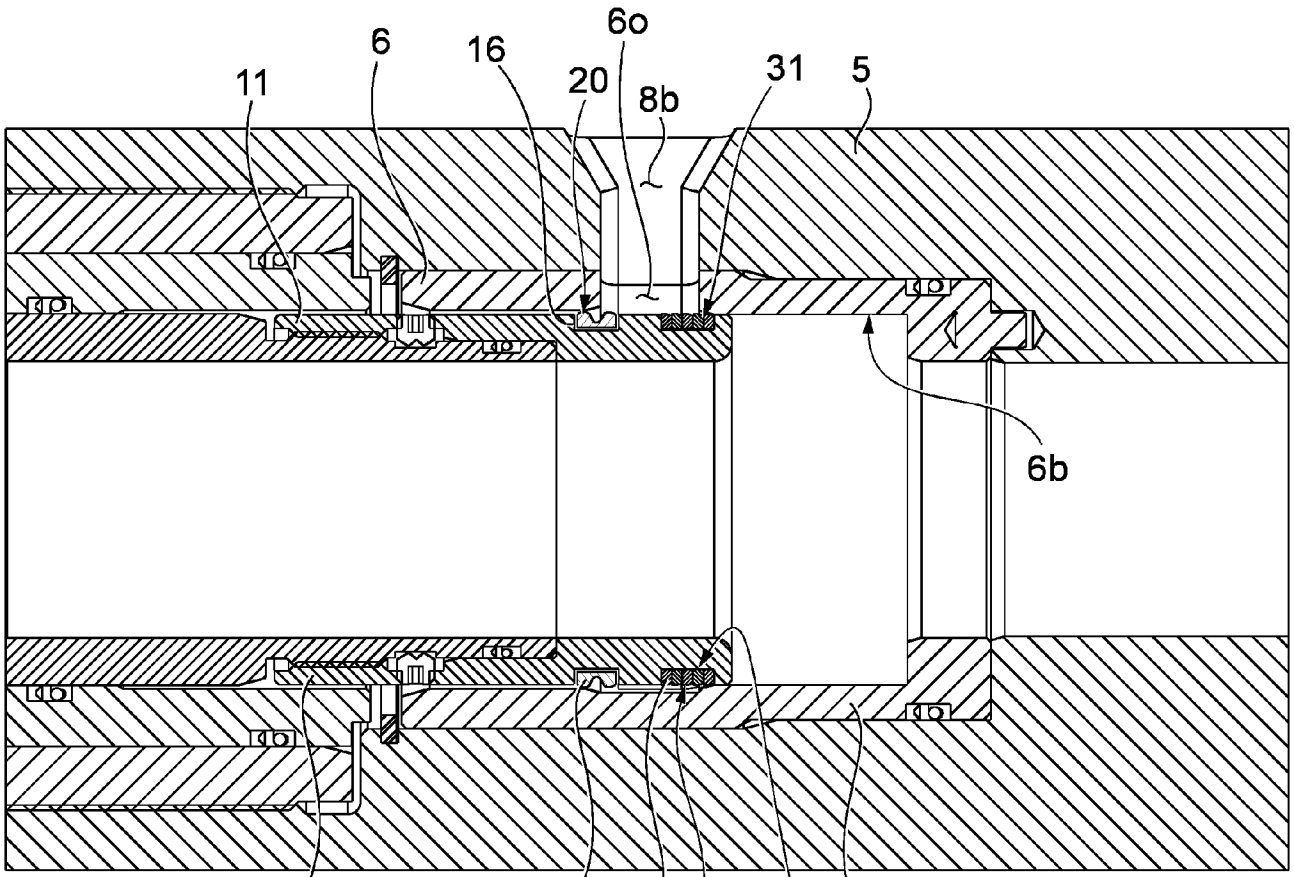
FIG. 5 is a side view of the second flow control device in the FIG. 4 valve in a partially open configuration.
Figure 6:
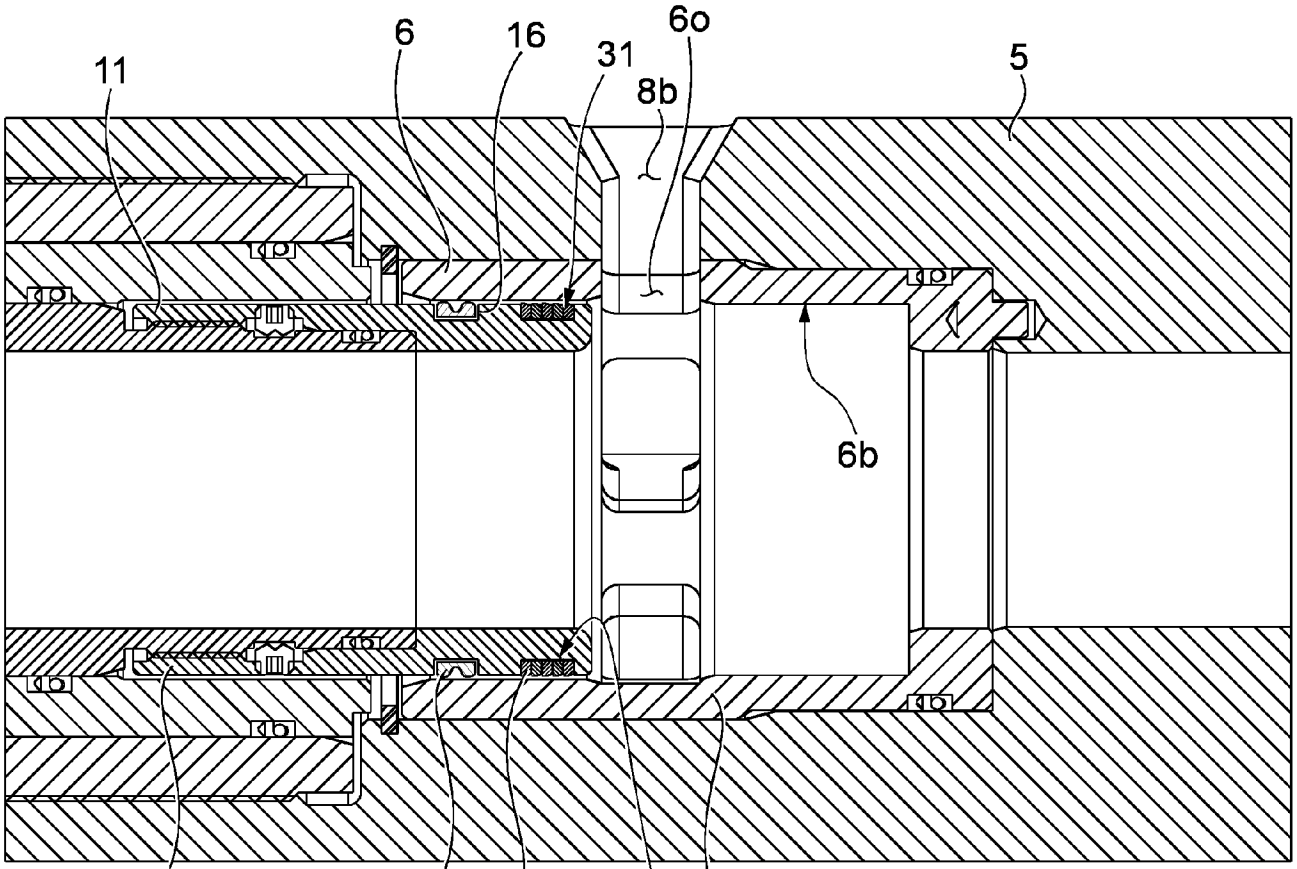
FIG. 6 is a side view of the second flow control device in the FIG. 4 valve in a fully open configuration.
Figure 14:
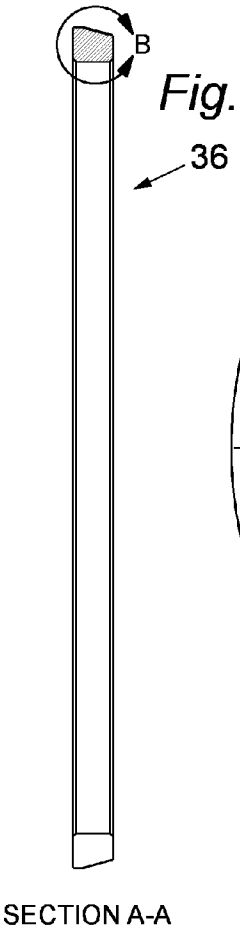
Figure 15:
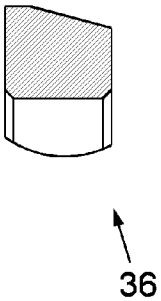
Figure 16:
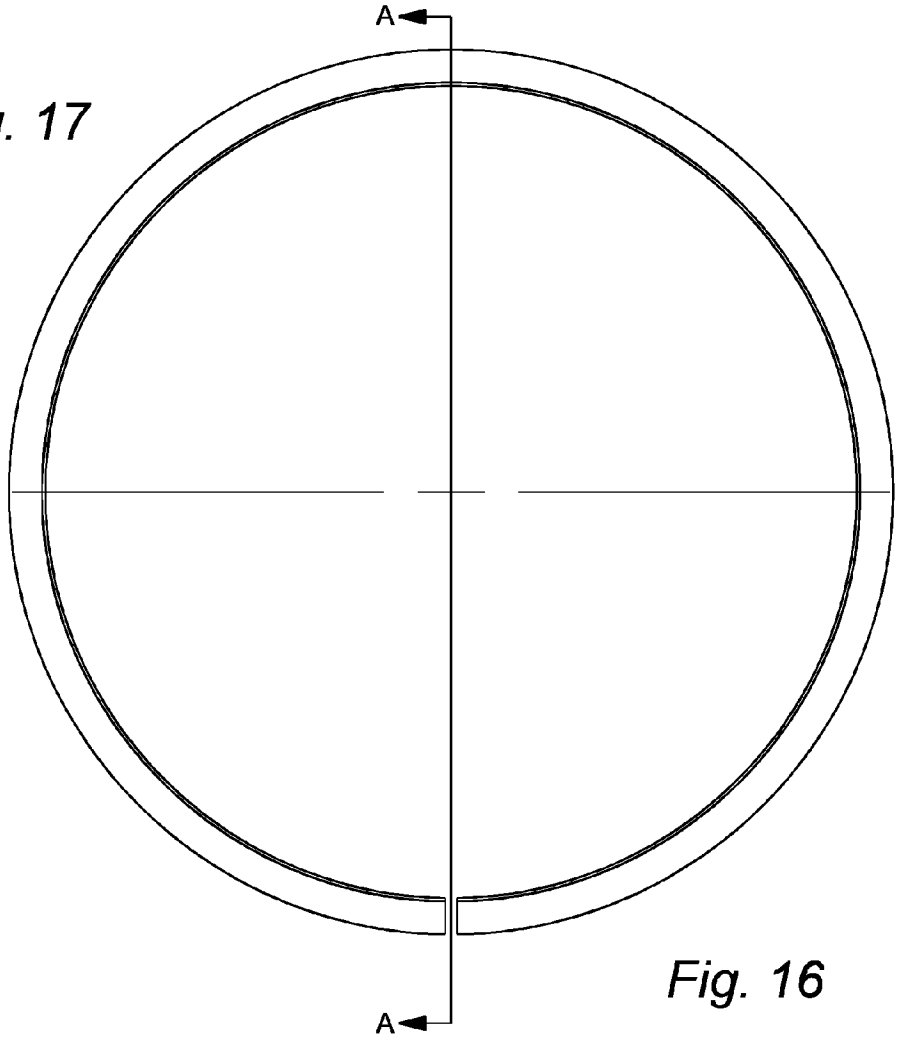
FIGS. 16, 17 and 18 are plan, side and expanded section views, respectively, of a ring from the third flow control device shown in FIGS. 7-9.

Turning now to the second embodiment, FIGS. 4-6 show an alternative design in which substantially the same body 5 is used, but the diffuser 31 comprises five thicker rings 36 located in a longer groove 27 in a modified sleeve 11. Also, the orifice 6*o* in the liner 6 has a bevelled recess at the inner bore 6*b*. The rings 36 as shown in FIGS. 14 and 15 are sprung like the rings 35 in the first embodiment, and occupy only part of the axial space in the groove 27, but whereas the rings 35 have flat outer faces, the rings 36 are typically bevelled at their outer faces. The outer bevelled faces of the rings are asymmetric, and slope toward the lower end of the sleeve 11. The bevel on the outer surface of the rings matches the bevel on the recess 6*o*. The rings of the second embodiment are typically made from titanium.

When the sliding sleeve 11 moves up, the seal 20 moves under the bevelled recess and is unloaded as it does not effectively seal against the bevelled recess. The diffuser 31 protects the seal 20 in the same way as described for the first embodiment, by denying the fluid flow a linear path through the annulus. When the diffuser 31 reaches the bevelled area, the rings 36 expand into the bevelled recess, and as the sleeve 11 moves up past the orifice 6*o* to the fully open configuration, the rings are compressed by the upper bevelled edge of the recess 6*o* to resume their original positions. The bevel on the outer surfaces of the rings 36 cooperates with the lower bevelled edge of the recess 6*o* when the sleeve 11 is sliding downward again, which reduces the tendency of the rings to jam the sleeve in a partially open position during the closing action. The rings 36 can optionally be bevelled on each of their upper and lower edges, and the bevel can optionally be symmetrical. Note that in the first embodiment, the un-recessed webs between the orifices press on the rings 35 during unloading, and prevent expansion of the rings 35 into the orifices.

Figure 7:
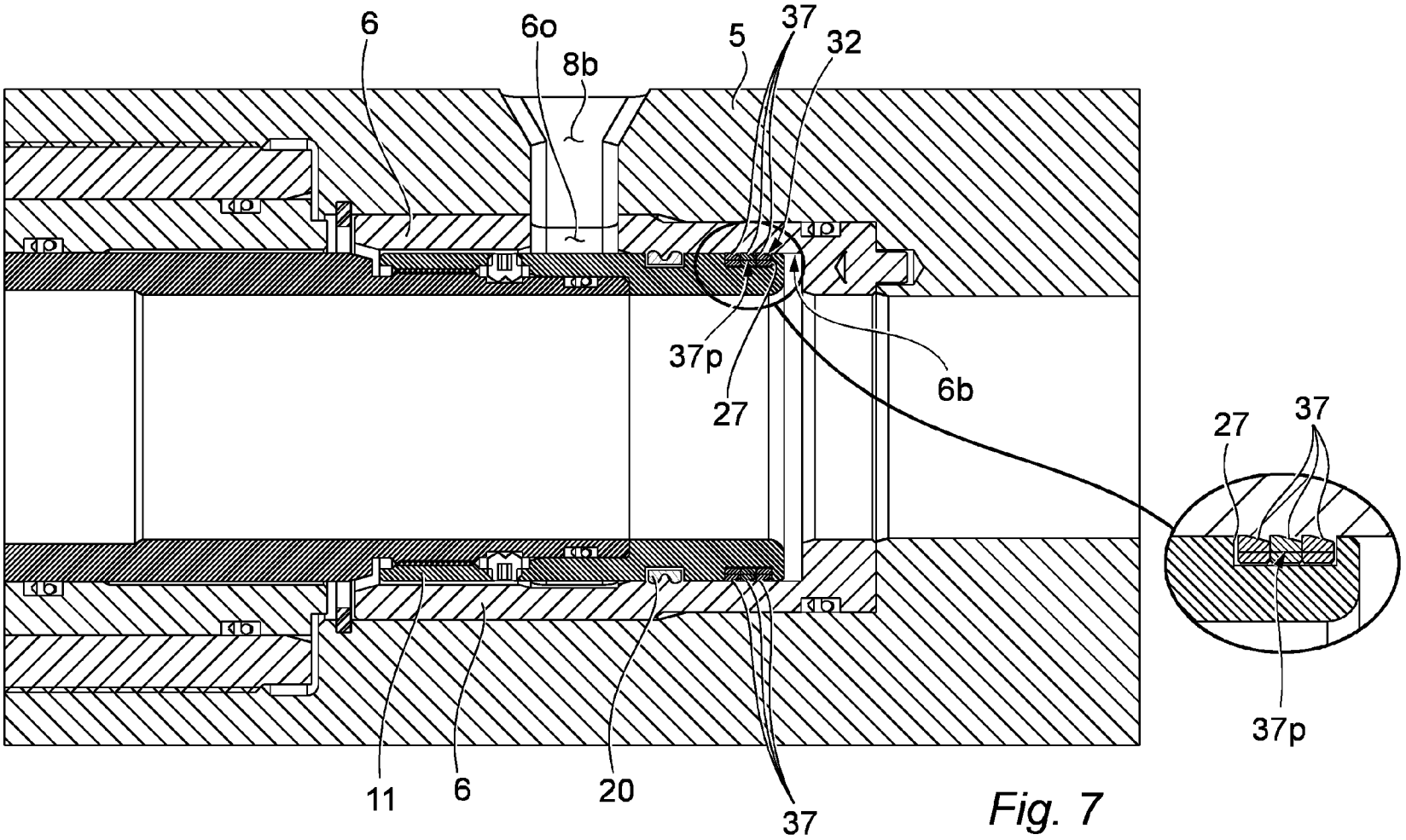
FIG. 7 is a side view of a third flow control device in a third sliding sleeve valve, in a closed configuration.
Figure 8:
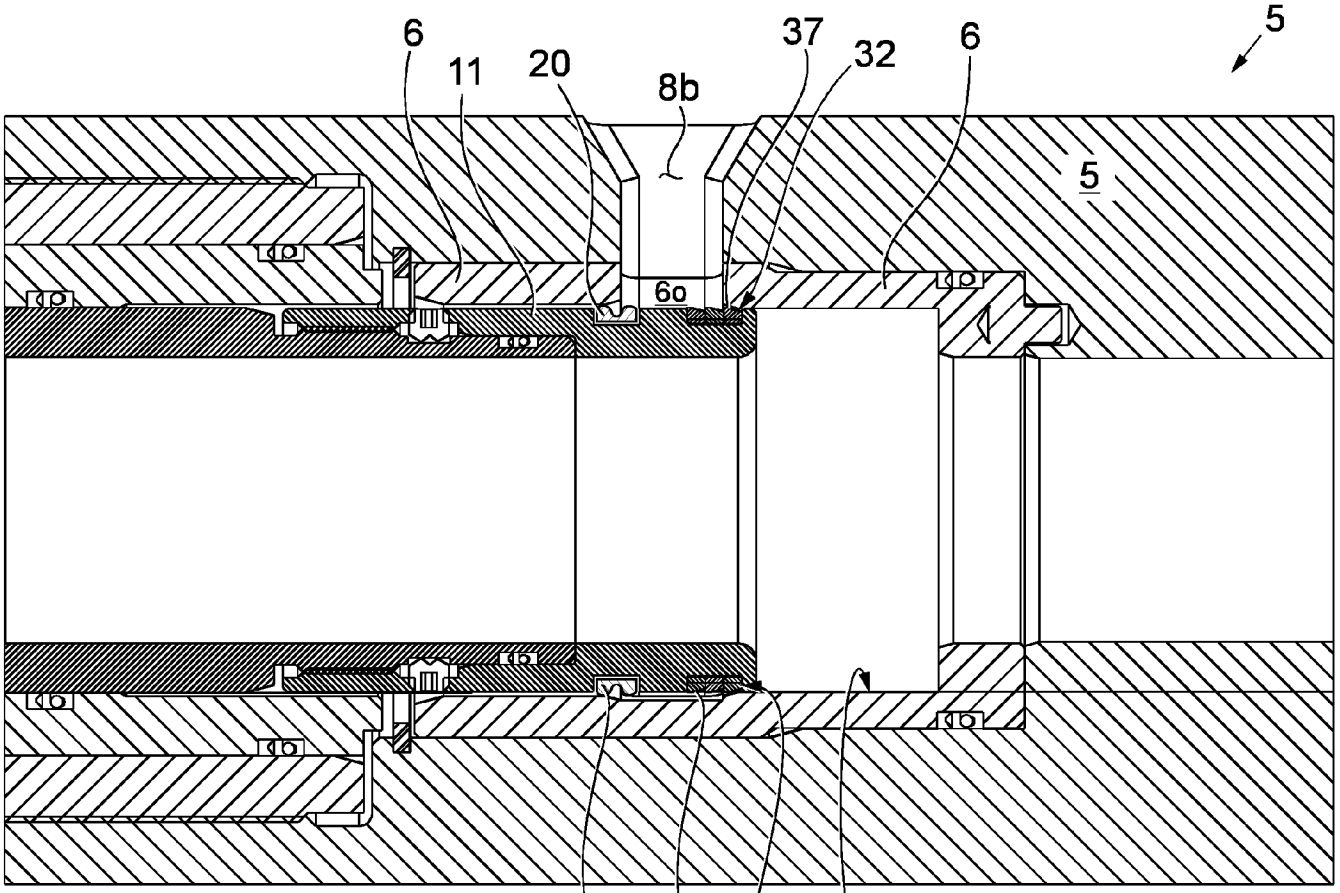
FIG. 8 is a side view of the third flow control device in the FIG. 7 valve in a partially open configuration.

Turning now to the third embodiment, FIGS. 7-9 show a alternative design which has substantially the same body 5, the same modified sleeve 11 as the second embodiment, the same liner 6 as the second embodiment, having the orifice 6*o* with the bevelled recess at the inner bore 6*b*, but having a different configuration of diffuser 32.

Figure 17:
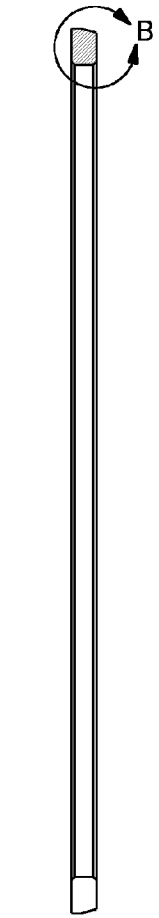
Figure 18:
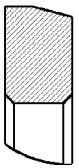
Figure 19:
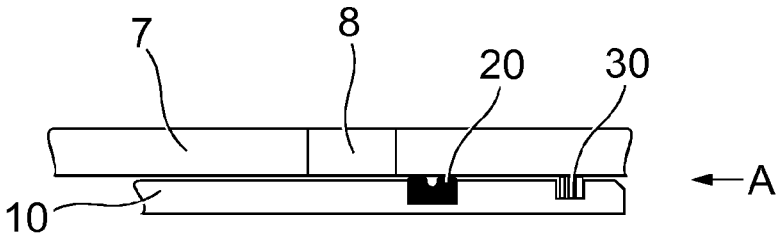
FIGS. 19-22 are sequential schematic views of the sliding sleeve in the first embodiment changing configuration from fully closed (FIG. 19) to fully open (FIG. 22)

The rings 37 of the diffuser 32 as shown in FIGS. 17 and 18 are made from cast iron and are sprung and bevelled like the rings 36, and again occupy only part of the axial space in the groove 27, but the rings 37 are thicker than the rings 35 and 36, and there are only three of them in the groove 27. The outer bevelled faces of the rings 37 behave in the manner described in relation to the second embodiment above.

The rings 37 are also pinned together by an optional indexing pin 37*p*, and are staggered circumferentially so that the gaps between their free ends do not occupy the same angular position on the sleeve. The indexing pin 37*p* maintains the angular positions of the rings 37, and so prevents them from rotating around the sleeve but allows them to move axially toward and away from one another. This prevents the rings from being moved to align the gaps and allow a more linear path for the fluid to move past the diffuser 32.

When the rings 37 are compressed against the upper end of the groove 27, the main leak path available to the fluid runs through the gaps between the free ends, and as these gaps are staggered in a fixed angular relationship to one another, the fluid pathway is labyrinthine and the force of the fluid flow is diffused. The pin 37*p* can be omitted, and if desired another form of indexing can be used, for example, a spline or rod or simple shoulders on the inner surface of the groove could keep the rings 37 in the desired angular relationship.

One benefit of the thicker rings 37 is that the spring force of the rings can be increased, and they can be more tightly pressed against the inner surface of the liner 6*b*, thereby further restricting the leak path for the fluid past the outer surface of the rings 37.

Figure 26:
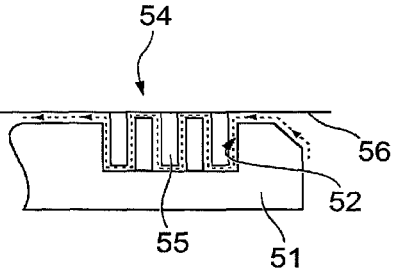
FIG. 26 is a close up schematic view of a fourth diffuser.

FIGS. 23-26 show other designs of fluid flow controller without a liner, and capable of being used in any of the embodiments. In the first design shown in FIG. 23, the diffuser 43 is located in a groove 42 in the sleeve 41. Three rings 45 are sprung outwardly against the body 46, thereby defining a labyrinthine flow path of least resistance indicated by the dotted line in FIG. 23. In the second modification shown in FIG. 24, the system is similar, but the three rings 45 are not sprung in the same direction, the central ring 45 having a resting position that urges it against the inner surface of the groove 42. Therefore, the labyrinthine flow path defined by the second modification is more convoluted than the FIG. 23 arrangement. In the third modification, the system is similar to the FIG. 23 arrangement with the rings 55 sprung outwardly against the body 56, but the diffuser 53 comprises five rings 55, set in a larger groove 52 in a modified sleeve 51. The fourth modification shown in FIG. 26 is similar to the second modification in FIG. 24, but the diffuser 54 has five rings 55 that are not sprung in the same direction, and adjacent rings 55 alternate between expanding against the inner surface of the body 56 and contracting against the outer surface of the groove 52. Thus the fluid flow path is more convoluted than before, and is also longer, giving more space and an enhanced baffling or diffusing effect. Other modifications to the diffuser are possible. The rings in the embodiments shown in FIGS. 23-26 can be cast iron or titanium.

Figure 27:
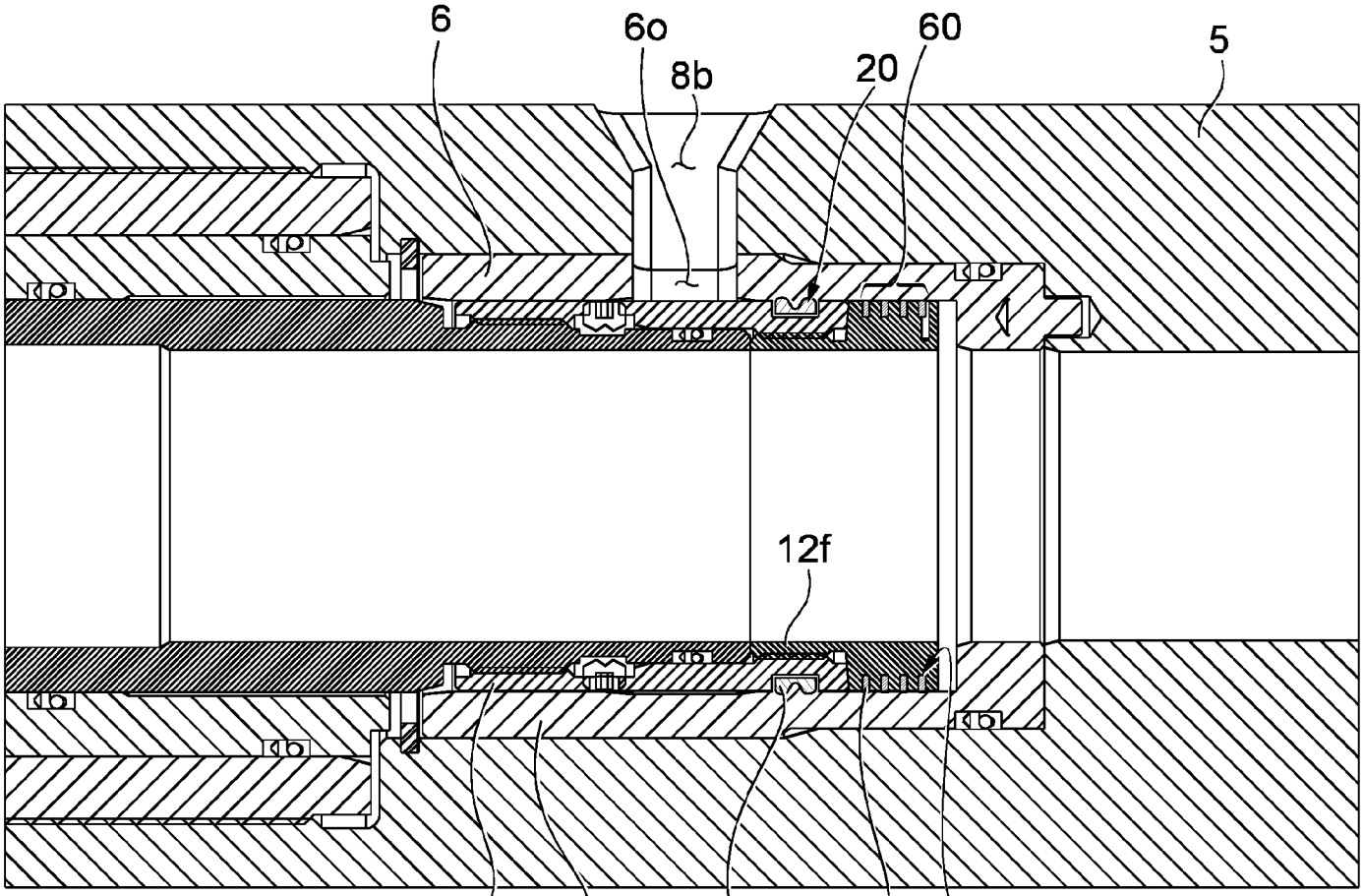
FIGS. 27-29 are side views of a further embodiment of a flow control device showing a transition between closed, partially open and open positions.
Figure 28:
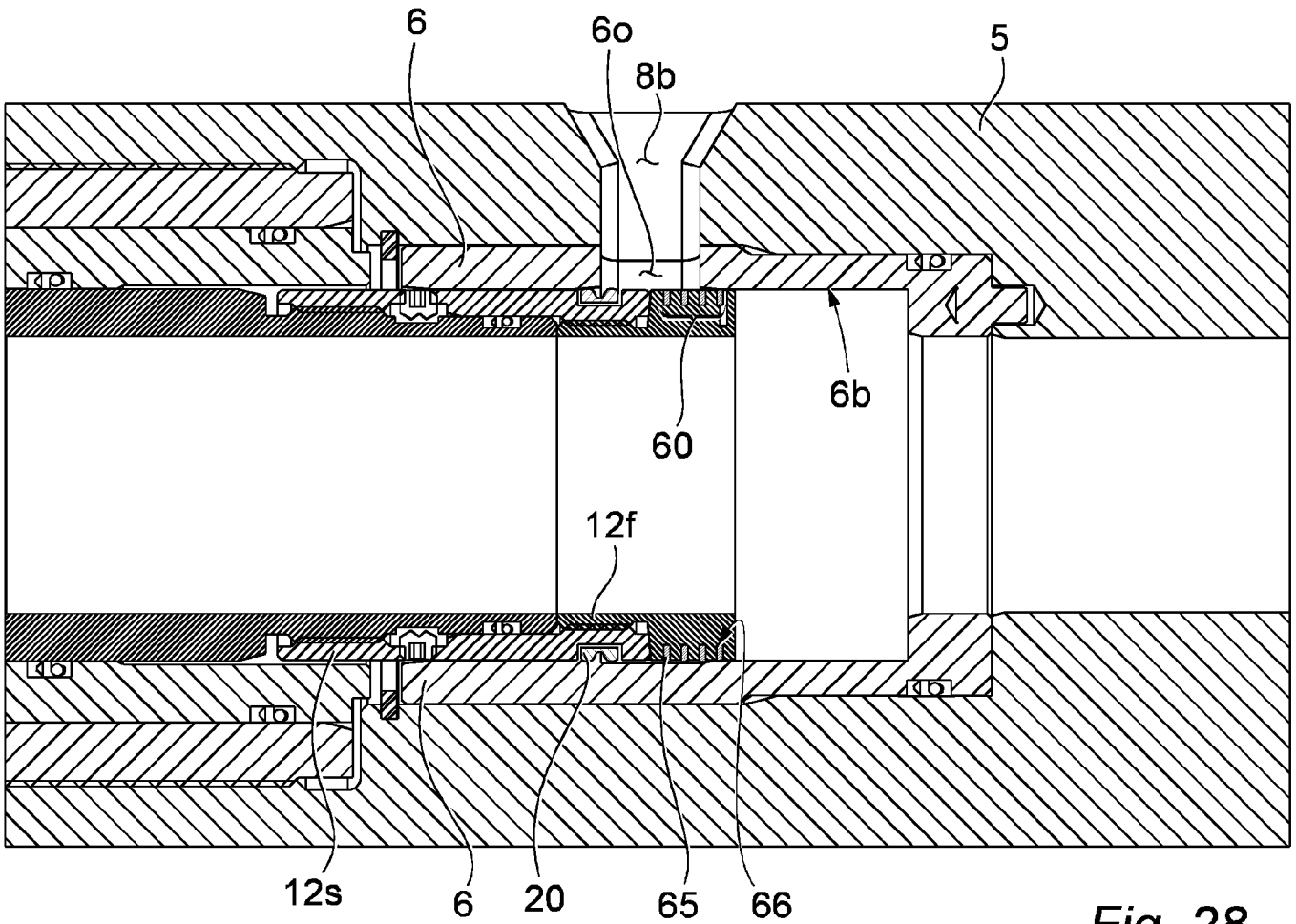
Figure 29:
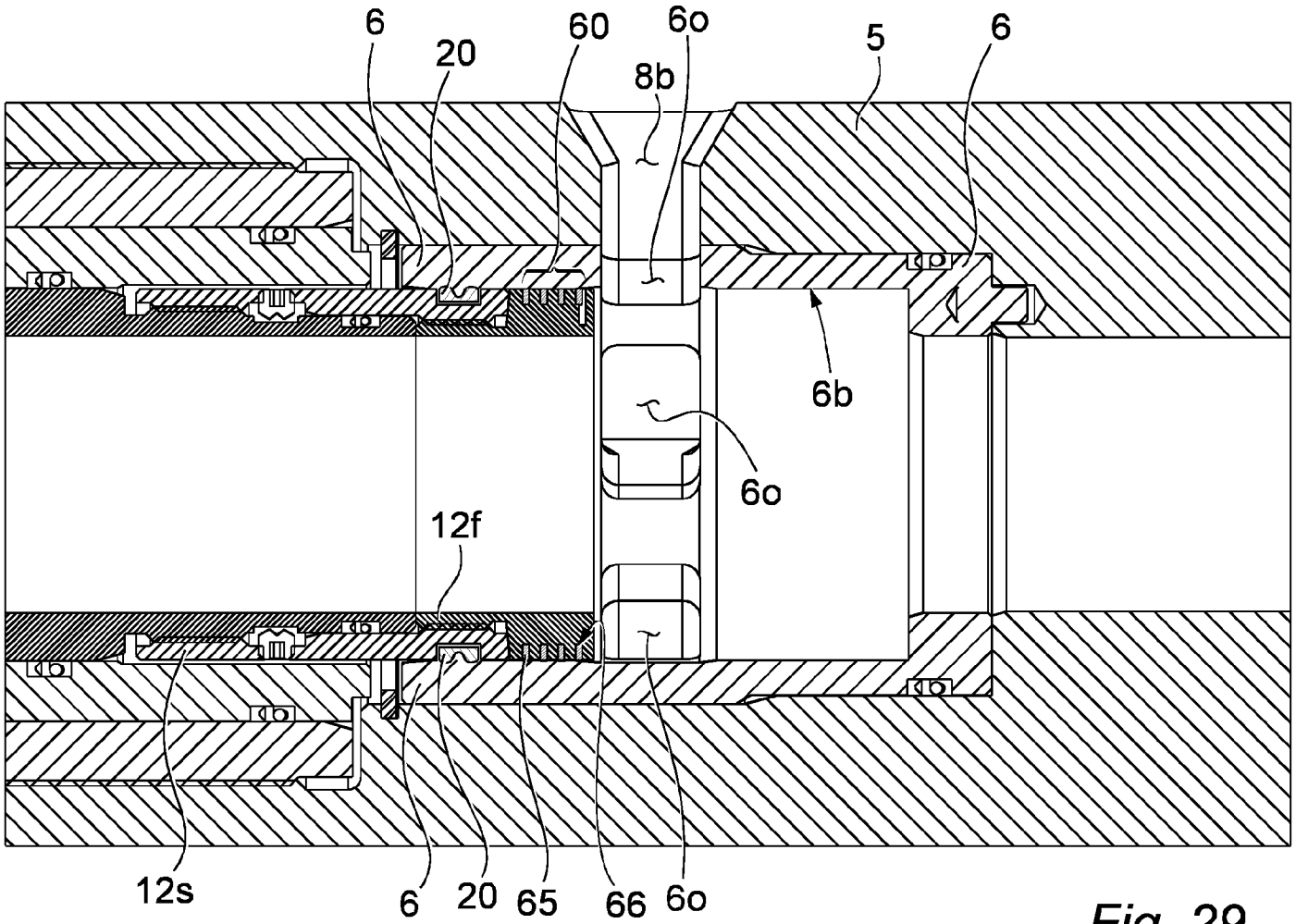

Referring now to FIGS. 27-29, a fourth embodiment is shown with substantially the same body 5, the same liner 6 as the second embodiment, having the orifice 6*o* with the bevelled recess at the inner bore 6*b*, but having a different sleeve 12 and a different configuration of fluid flow controller 60.

The sleeve 12 is formed of two parts, a seal portion 12*s* which bears the seal 20 similar to that previously described, and a fluid flow control portion 12*f* that bears the fluid flow controller 60. The seal portion 12*s* has an external thread at one end and the fluid flow control portion 12*f* has an internal thread, which engages the external thread on the seal portion 12*s* to connect the two portions together.

The fluid flow controller 60 comprises five resilient cast iron rings 65, each split and sprung to allow the ring to expand radially to pass over the outer surface of the fluid flow control portion 12*f* of the sleeve 12. The outer surface has five axially spaced annular grooves 66, each of which accommodate a single ring 65. Each ring 65 snaps into the groove 66 under the force of its own resilience.

Each ring 65 has split ends, and although not necessary for each embodiment, in this case, the split ends can overlap to create a labyrinthine path for fluid flow. The rings 65 of the diffuser 60 are optionally bevelled like the rings 36, and again may typically occupy only part of the axial space in the groove 66. The grooves 66 and the rings 65 are typically parallel and axially spaced apart at equal distances. The outer bevelled faces of the rings 65 optionally behave in the manner described in relation to the second embodiment above.

When the fluid flow controller 60 is subjected to a pressure differential as a result of the seal unloading as described above, the rings 65 are compressed against the upper end of the groove 66, and the main leak path available to the fluid runs through the overlapping area between the free ends of each ring 65, and as this requires the fluid flow to change direction several times in the course of transitioning through the fluid flow controller, the fluid pathway is labyrinthine and the force of the fluid flow is diffused, reducing the flow rate that reaches the seal 20.

Figure 30:
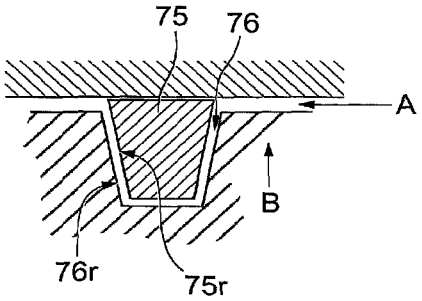
FIG. 30 is an enlarged side view of a ring in a groove of a further embodiment of a flow control device.

In one embodiment the fluid flow controller can be modified as shown in FIG. 30. In FIG. 30, a modified ring 75 is shown in a modified groove 76. The ring 75 and the groove 76 have radial walls 75*r* and 76*r*, which are inclined at the same angle, e.g. 5-10 degrees e.g. 7 degrees with respect to the radial axis of the ring, so that the radial wall of the ring 75 and the radial wall of the groove 76 are not orthogonal to the long axis of the annular ring 75. This creates an oblique angle in the direction of fluid flow, and creates a wedging effect on the ring. Fluid flowing in the direction of arrow A in FIG. 30 therefore drives the ring 75 against the upstream radial wall 75*r*, so that the flat portions of the walls 75*r* and 76*r* are pressed together. Because of the inclined faces of the walls 75*r* and 76*r*, the wedging effect drives the ring radially outward as well as axially against the face 76*r* of the groove 76. This pushes the ring 75 outwardly against the inner surface of the liner in the direction of arrow B, and creates a barrier to the passage of fluid flowing past the ring 75.

The modified ring can be provided alone in a single groove, as shown in FIG. 30, or can be stacked with other rings in the same groove as in previous embodiments 1-3. The modified ring can be provided with a single inclined radial face on its downstream surface, so as to seal only in a single direction when subjected to a pressure differential urging it in the direction of arrow A, or can be provided with inclined radial faces on both (e.g. opposite) sides, in which case, each face can be inclined at the same or a different angle.

Modifications and improvements can be incorporated without departing from the scope of the invention.

The invention claimed is:

1. A downhole flow control device comprising:

a body portion with an orifice that allows fluid flow through the orifice;

a control portion that changes configurations between a first configuration that allows fluid flow through the orifice and a second configuration that restricts fluid flow through the orifice;

a fluid flow controller disposed between the body portion and the control portion;

wherein the fluid flow controller comprises at least one annular member disposed in a recess in one of the body portion and the control portion;

wherein the fluid flow controller has a leak path that is opened and closed by a pressure differential acting across the at least one annular member;

wherein the at least one annular member comprises a first ring with a first split between a first end of the first ring and a second end of the first ring, and a second ring with a second split between a first end of the second ring and a second end of the second ring;

wherein the first split and the second split provide the leak path for passage of fluid between the ends of the first ring and the second ring;

wherein the first split between the ends of the first ring is circumferentially staggered out of alignment with the second split between the ends of the second ring; and wherein a rotational position of the first ring relative to the second ring is maintained within the recess.

2. A flow control device as claimed in claim 1, wherein the recess has an axis, and wherein the at least one annular member has an axis that is arranged parallel to the axis of the recess.

3. A flow control device as claimed in claim 1, wherein the leak path through the fluid flow controller is varied by action of pressure differentials acting on the flow controller to change the configuration of the at least one annular member, and wherein the change in configuration of the at least one annular member comprises axial movement of the annular member within the recess.

4. A flow control device as claimed in claim 1, wherein each annular member has a central axis, wherein the annular members are arranged parallel to one another and with the axes of the annular members being aligned with the axis of the recess.

5. A flow control device as claimed in claim 1, wherein the pressure differential acting across the annular member causes the annular member to move radially out of the recess.

6. A flow control device as claimed in claim 1, wherein the at least one annular member is radially biased in the recess to press against one of the control portion and the body portion and is spaced radially apart from the other of the control portion and the body portion.

7. A flow control device as claimed in claim 1, wherein the flow controller provides a metal to metal seal.

8. A flow control device as claimed in claim 1, wherein an axial dimension of the recess is longer than a total axial dimension of the at least one annular member, permitting axial movement of the annular member within the recess when the pressure differential is applied across the annular member.

9. A flow control device as claimed in claim 1, wherein the fluid flow controller is located upstream of the orifice with respect to a direction of fluid flow, and upstream of any seal that is sealing the orifice.

10. A flow control device as claimed in claim 1, wherein the fluid flow controller defines a labyrinthine passage for diffusing fluid flowing through the orifice.

11. A flow control device as claimed in claim 1, wherein the at least one annular member comprises a metal ring.

12. A flow control device as claimed in claim 1, wherein the first split and the second split overlap one another and wherein the leak path includes an overlapping region of the rings.

13. A flow control device as claimed in claim 1, having more than one annular member in the flow controller, and wherein the annular members are of different resting diameters so that they are radially offset with respect to one another.

14. A flow control device as claimed in claim 1, wherein a radially outer edge of the at least one ring annular member is bevelled.

15. A flow control device according to claim 1, having more than one annular member, and wherein each annular member is disposed in a respective recess.

16. A flow control device as claimed in claim 1, wherein the annular member and the recess each have faces that are parallel to one another, and wherein the faces are pressed together by the pressure differential acting across the annular member, thereby closing the leak path.

17. A flow control device as claimed in claim 16, wherein the face of the recess comprises a radial end wall and wherein the radial end wall of the recess and the face of the annular member that is pressed against it are each inclined and are not orthogonal to their respective central axes.

18. A flow control device as claimed in claim 1, including a seal in addition to the fluid flow controller.

19. A flow control device as claimed in claim 18, embodied in a sliding seal valve, wherein the body portion and the control portion comprise sleeves, and wherein an axial distance between the fluid flow controller and the seal is not less than a distance across the orifice, so that the seal and the fluid flow controller do not engage the orifice at the same time.

20. A flow control device according to claim 1, having more than one annular member, and wherein the recess has at least two annular members disposed therein.

21. A flow control device according to claim 20, wherein the annular members located in the recess are stacked pressing against one another within the recess.

22. A flow control device according to claim 20, wherein the pressure differential applied to the flow controller compresses the annular members against a radially extending end face of the recess, thereby reducing a cross sectional area of the leak path through the fluid flow controller.

23. A flow control device comprising:

a body portion with an orifice that allows fluid flow through the orifice;

a control portion that changes configurations between a first configuration that allows fluid flow through the orifice, and a second configuration that restricts fluid flow through the orifice;

a fluid flow diffuser disposed between the body portion and the control portion;

wherein the fluid flow diffuser comprises:

a first ring maintained in a first recess in one of the body portion and the control portion at a first rotational position and having a first split between a first end of the first ring and a second end of the first ring: and a second ring maintained in a second recess in one of the body portion and the control portion in a second rotational position, and having a second split between a first end of the second ring and a second end of the second ring;

wherein the first split and the second split provide a leak path for passage of fluid between the ends of the first ring and the second ring;

wherein the first split is circumferentially staggered out of alignment with the second split when the first ring is in the first rotational position and the second ring is in the second rotational position;

and wherein the first and second rotational positions of the first ring and the second ring are maintained within the first and second recesses.

24. A flow control device comprising:

a body portion with an orifice that allows fluid flow through the orifice;

a control portion that changes configurations between a first configuration that allows fluid flow through the orifice and a second configuration that restricts fluid flow through the orifice;

a fluid flow controller disposed between the body portion and the control portion wherein the flow controller has a leak path for fluid, wherein the fluid flow controller comprises:

at least one recess in one of the body portion and the control portion;

a first ring with a split between a first end of the ring and a second end of the ring; and a second ring with a split between a first end of the ring and a second end of the ring, wherein the leak path passes through each of the splits between the first and second ends of each ring;

wherein the leak path is opened and closed by a pressure differential acting across the first and second rings;

wherein the device includes an indexing device engaging the first and second rings, and restricting relative rotation between the first and second rings; and wherein the split between the ends of the first ring is circumferentially staggered out of rotational alignment with the split between the ends of the second ring, and wherein the rotational position of the first ring relative to the second ring is maintained.

* * * * *